US005118535A

United States Patent [19]

Cray et al.

[11] Patent Number: 5,118,535

[45] Date of Patent: Jun. 2, 1992

[54] METHOD OF TREATING FIBROUS MATERIALS

[75] Inventors: Stephen E. Cray, Sully, Wales; Franck A. D. Renauld, Gistoux, Belgium

[73] Assignee: Dow Corning Limited, Barry, Wales

[21] Appl. No.: 646,031

[22] Filed: Jan. 28, 1991

[30] Foreign Application Priority Data

Feb. 7, 1990 [GB] United Kingdom ..... 9002715

[51] Int. Cl.[5] ..... B05D 3/02

[52] U.S. Cl. ..... 427/387; 427/389.9; 252/8.6; 8/115.59; 428/391; 528/33

[58] Field of Search ..... 427/387, 389.9; 8/115.59; 252/8.6; 528/33; 428/391

[56] References Cited

U.S. PATENT DOCUMENTS

| | | | |
|---|---|---|---|
| 3,524,900 | 8/1970 | Gibbon et al. | 528/33 |
| 4,059,581 | 11/1977 | Prokai | 544/69 |
| 4,098,701 | 7/1978 | Burrill | 252/8.6 |
| 4,587,321 | 5/1986 | Sebag et al. | 528/33 |
| 4,757,121 | 7/1988 | Tanaka | 528/27 |
| 4,874,662 | 10/1989 | Huhn | 428/266 |
| 4,892,918 | 1/1990 | Ryang | 528/15 |

*Primary Examiner*—Michael Lusignan

*Assistant Examiner*—Diana Dudash

*Attorney, Agent, or Firm*—George A. Grindahl

[57] ABSTRACT

A method of treating fibrous materials comprises applying a polydiorganosiloxane having at least one unit (a) of the general formula

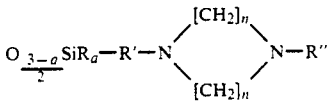

and at least one unit (b) of the general formula

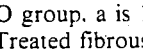

wherein R is a hydroxyl, monovalent hydrocarbon or hydrocarbonoxy group, R′ is a divalent hydrocarbon group which optionally contains oxygen and/or nitrogen, R″ is a hydrogen atom or an alkyl group optionally containing an oxygen atom in the form of a hydroxyl group and/or a C=O group, a is 1 or 2, b 2 or 3 and each n from 2 to 8. Treated fibrous materials have improved softness with improved non-yellowing characteristics.

16 Claims, No Drawings

METHOD OF TREATING FIBROUS MATERIALS

This invention relates to a method of treating fibrous materials and more specifically to a method of treating textile materials.

With the expression fibrous materials is meant fibres of synthetic or naturally occurring materials for example wool, cotton, polyester and blends of these. The invention relates to the treatment of the fibres as such but more specifically to the treatment of fabrics or textiles incorporating the fibres.

It is known, e.g. from U.S. Pat. No. 4 098 701 to treat fibrous materials with compositions comprising amine-containing silicone compounds for imparting desirable properties e.g. softness, water repellency, lubricity and crease resistance thereto. However, amine-containing siloxane materials tend to give a certain amount of yellowing of treated fibres due to oxidation. In U.S. Pat. No. 4 757 121 it has been proposed to overcome the yellowing problem when treating synthetic fibre made waddings by using a composition comprising 100 parts by weight of a combination of two organopolysiloxanes composed of from 5 to 95% by weight of an amino-substituted organopolysiloxane, and 95 to 5% by weight of a second amino-substituted organopolysiloxane, which is a reaction product of a liquid amino-substituted organopolysiloxane and a liquid organic epoxy compound, from 1 to 50 parts by weight of an epoxy-containing alkoxy silane and from 1 to 50 parts by weight of a monoepoxy compound. E.P. patent specification 306 935 also discloses a method of treating fibrous materials which is claimed to reduce the yellowing effect, when compared with amine containing siloxane materials. This specification suggests the use of an organopolysiloxane which comprises diorganosiloxane units which are substituted with monovalent silicon-bonded hydrocarbon groups and at least two nitrogen containing silicon-bonded groups, of which at least some consist of N-cyclohexylaminoalkyl groups.

We have found that improved characteristics can be imparted to fibrous materials by treating them with certain cyclic diamine-containing organosiloxane polymers.

According to the invention there is provided a method of treating fibrous materials, which comprises the application to fibrous materials of a polydiorganosiloxane having at least one unit of the general formula

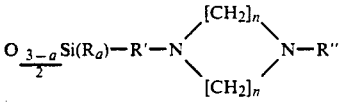

(a)

and at least one unit having the general formula

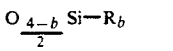

(b) wherein R denotes a hydroxyl group or a monovalent hydrocarbon or hydrocarbonoxy group having up to 18 carbon atoms, R′ denotes a divalent hydrocarbon group which optionally contains oxygen and/or nitrogen, R″ denotes a hydrogen atom or an alkyl group, optionally containing an oxygen atom in the form of a hydroxyl group and/or a C=O group, a has a value of 1 or 2, b has a value of 2 or 3 and each n independently has a value of from 2 to 8.

The polydiorganosiloxane used in the method of the invention may be a cyclic, linear or branched siloxane polymer, but preferably it is a substantially linear polymer, although small amounts of siloxane units which cause branching of the siloxane polymer are acceptable. Units which cause branching should not be present in more than 10% of the total number of units and have the general structure $O_{3/2}SiR$. Preferably up to 1% of units that cause branching are included.

The substituent R may be a hydroxyl, hydrocarbon or hydrocarbonoxy group. Preferably R denotes only a hydroxyl or hydrocarbonoxy group in terminal siloxane units. If a hydrocarbonoxy group is present it is preferably an alkoxy group, most preferably a methoxy group. Any remaining R groups may be any hydrocarbon group having up to 18 carbon atoms, for example alkyl, e.g. methyl, ethyl, isopropyl, hexyl, dodecyl and octadecyl, aryl, e.g. phenyl, alkenyl, e.g. vinyl, allyl, butenyl and hexenyl, alkylaryl, e.g. tolyl and arylalkyl, e.g. phenylethyl. Preferably R denotes a lower alkyl group. It is preferred that at least 80%, most preferably substantially all R groups are lower alkyl groups, most preferably methyl groups.

The group R′ is a divalent hydrocarbon group which may contain oxygen and/or nitrogen. The oxygen if present will be selected from ether oxygen, carboxylic oxygen, amido oxygen and hydroxyl groups. In order to ensure the best results in the method of the invention it is preferred that the N atoms which may be present will not be present as primary amine groups. The R′ group depends mainly on the method used for producing the cyclic diamine functional polydiorganosiloxanes, as will be described below. Preferably R′ is a divalent alkylene group having up to 8 carbon atoms, most preferably from 2 to 8 carbon atoms. Examples of the R′ group include dimethylene, propylene, isobutylene, hexylene, $—(CH_2)_3—O—CH_2CH(OH)CH_2$, $—(CH_2)_3—O—(CH_2)_2—$ and $—(CH_2)_3—C(O)NH(CH_2)_2—$. It is, however, preferred that the R′ linking group between the silicon atom and the cyclic diamine group is as short as possible in order to achieve the best results on treated textile fibres and fabrics. Preferred groups are therefore alkylene groups with 2 or 3 carbon atoms in the chain linking the silicon to the nitrogen atom, e.g. dimethylene, isopropylene, propylene and isobutylene groups.

The groups R″ may be hydrogen or an alkyl group, optionally containing an oxygen atom in the form of a hydroxyl group and/or a C=O group. Preferred groups R″ are hydrogen and lower alkyl groups, e.g. methyl, ethyl and propyl. Other examples of the group R″ include butyl, neopentyl, $—CH_2CH(OH)CH_3$, $—C(O)(CHZ)_pOH$ and $—(CH_2)_3C(O)OH$ wherein Z is hydrogen or an alkyl group having up to 8 carbon atoms and p has a value from 2 to 6; a has a value of 1 or 2, which means that the siloxane unit which contains the cyclic diamine group, may be located in the siloxane chain or may be an end-unit of the siloxane chain. Preferably the value of a is 1, placing the cyclic amine groups as pending substituents in the siloxane chain. The value of each n is from 2 to 8, preferably each n has a value of from 2 to 4, most preferably 2. Examples of the cyclic diamine part of the substituent include 1,4-diazocyclohexane (piperazine), 1,5-diazocyclooctane, 1,7-diazocyclododecane, 1,4-diazo-3,6-dimethylcyclohexane, 1,4-diazocycloheptane, 1,4-diazocyclooctane. Examples of the siloxane unit which contains the cyclic diamine, wherein $N^*$ denotes

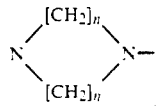

are $OSi(CH_3)(CH_2)_3N^*H$, $OSi(CH_3)CH_2CH(CH_3)CH_2N^*H$, $OSi(CH_3)CH_2CH(CH_3)CH_2N^*CH_3$, $O_{\frac{1}{2}}Si(CH_3)_2CH_2CH(CH_3)CH_2N^*H$, $O_{\frac{1}{2}}Si(CH_3)_2(CH_2)_3N^*CH_2CH(OH)CH_3$, $OSi(CH_3)(CH_2)_3OCH_2CH(OH)CH_2N^*H$, $OSi(CH_3)(CH_2)_3—O—(CH_2)_2N^*CH_3$ and $OSi(CH_3)(CH_2)_3C(O)NH(CH_2)_2N^*H$.

The other units of the polydiorganosiloxane are units of the general formula (b), wherein b has a value of 2 or 3 and R has the meaning denoted above. This means that the units may be present in the siloxane chain and as end-units of the chain. It is preferred that the polydiorganosiloxane has from to 10 to $10^5$ siloxane units present of type (a) and (b) combined, particularly from 100 to 1000 units, typically about 500 units. The viscosity of the polydiorganosiloxane tends to determine the softness which is imparted to the treated materials, the higher the viscosity the softer the finish. However, for reasons of practicality it is preferred to use those materials which are liquid at room temperature.

It is also preferred that from 0.1 to 20 mole % of all siloxane units in the polydiorganosiloxane which is suitable in the method of the invention are units of the formula (a), preferably from 1 to 10 mole %, most preferably from 1 to 4 mole %. Amounts above 20 mole % are unlikely to contribute additional beneficial effects to the treated materials, while less than 0.1 mole % is unlikely to impart the desired characteristics to the treated substrate.

Some suitable siloxane polymers for use in the method of the invention are known in the art. They have been mentioned for example in U.S. Pat. No. 4 059 581 and E.P. patent specification 312 771. They can be made by methods known in the art. Cyclic diamine functional silanes or their hydrolysis products may be condensed with cyclic diorganosiloxanes in the presence of end-blocking units. For example propylpiperazinyl methyldimethoxy silane or piperazinylmethyl cyclosiloxane may be condensed with cyclic dimethyl siloxanes in the presence of hexamethyldisiloxane as end-blocker. This type of condensation reaction is preferably carried out in the presence of known condensation catalysts, for example tin or zinc compounds, e.g. tin carboxylates such as dibutyl tin dilaurate. Alternatively the polydiorganosiloxanes which are suitable for use in the method of the invention may be prepared by reacting a cyclic diamine containing compound with a polydiorganosiloxane of the required chain length having reactive silicon-bonded substituents. Whether silanes or siloxanes are prepared initially the cyclic diamine containing substituents may be linked to the silicon atom by known methods. These include for example the reaction of a silicon-bonded carboxyl functional substituent or acyl substituent with an aminoethyl substituted cyclic diamine (e.g. aminoethylpiperazine). A further method is the reaction of a silicon-bonded epoxy-functional substituent with an unsubstituted cyclic diamine (e.g. piperazine). Yet another possible method is the addition reaction to a silicon-bonded hydrogen group of an alkenyl group containing cyclic diamine compound, e.g. N-vinylpiperazine and N-allylpiperazine, preferably in the presence of a hydrosilylation catalyst, e.g. a platinum or palladium compound or complex. A further possible method of preparing these compounds is the addition reaction of cyclic diamino compounds of the formula

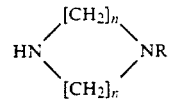

to silicon-bonded alkenyl substituents in the presence of e.g. a lithium catalyst and the reaction of haloalkyl substituted silicone compounds with cyclic diamines which have at least one unsubstituted nitrogen atom.

The method of the invention comprises the application to fibrous materials of a diorganosiloxane polymer as described above. This application may be done in any convenient way. Application methods which are suitable include padding, dipping and spraying of the polymer or of a composition comprising the polymer. Compositions comprising the above described polydiorganosiloxane may be in any suitable form, e.g. a solution, a dispersion or an emulsion. Dispersions may be in aqueous or solvent based media while the emulsions are preferably of the oil-in-water type. Suitable solvents for solutions include aromatic solvents, e.g. toluene. Especially preferred, however, are emulsions. Suitable emulsions comprise from 5 to 25% of the diorganosiloxane polymer, preferably 10 to 15% by weight. These emulsions may also comprise other ingredients or they may be used alongside or in admixture with emulsions, solutions or dispersions comprising such other ingredients. Examples of suitable ingredients are stabilising emulsifiers, thickeners, crease resist resins, dyes, organic softening agents and other ingredients which are useful for the treatment of fibrous materials, e.g. fatty acid softeners and polyethylene polymer based components.

The method of the invention is suitable for the treatment of both naturally occurring and synthetic fibres for example carbon fibres, polyester fibres, cotton fibres and blends of cotton and polyester fibres. It is preferred to apply sufficient of the polydiorganosiloxane to achieve a treatment in which the fibrous material or textile will receive from 0.1 to 5% by weight of the diorganosiloxane polymer, most preferably 0.2 to 1% by weight. The application may be done at the stage of making the fibres, at the stage of producing the fabrics or in a special treating step later, for example during laundering of a textile fabric. Application may be followed by drying at room temperature or at increased temperatures. After the drying stage a further heat treatment of the fibrous materials is preferred. The latter is particularly useful when the textile fabrics are treated at the time of their production or at the time they are made into garments etc. The application of siloxane polymers suitable for use in accordance with the invention provide the treated substrates with improved characteristics of softness and handle and with a reduced tendency to yellowing the substrate compared to prior art textile and fibre finishing compositions.

In a different aspect of the invention there is provided a fibrous material treated according to the method of the invention. Also included are fabrics or textiles incorporating fibres when treated according to the method of the invention.

There now follow a number of examples illustrating the invention in which all parts are expressed by weight unless otherwise mentioned.

EXAMPLE 1

A siloxane of the average formula $(CH_3)_3SiO[(CH_3)_2SiO]_{392}[CH_3SiO]_8Si(CH_3)_3$ wherein R denotes a group of the formula

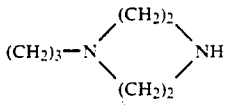

was prepared as follows.

A flask was equipped with a stirrer, condenser, dropping funnel and nitrogen blanket. 344 g (4 mole) of piperazine was charged together with 22 g of toluene. The mixture was heated to 110° C. and 182.4 g (1 mole) of chloropropyl metlhyl dimethoxy silane were slowly added. An exothermic reaction was observed. After complete addition the solution was maintained at 110° C. for 1 hour. After cooling to 20° C. the mixture was filtered, washed and distilled (110° C. and 50 mbar) giving a silane of the formula

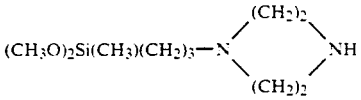

in a yield of 80% of the theoretical value. The silane was analysed by proton NMR and further hydrolysed by adding excess water to it at reduced pressure (2.6 mbar) and heating to a temperature of 110° C. till all the excess water was stripped off. This gave a polymeric siloxane hydrolysate which is believed to be a mixture of cyclic and linear siloxanes. 78.7 g of the hydrolysate was then equilibrated with 1530.3 g of octamethylcyclotetrasiloxane and 12.5 g of hexamethyldisiloxane end-blocker in the presence of 8.3 g of K-silanolate based catalyst. The equilibration reaction took place under a nitrogen blanket at 140° C. for 5 hours, after which the excess catalyst was neutralised with acetic acid. The resulting polymer was analysed by gel permeation chromatography and had a molecular weight of about 36,000.

The polymer was formulated into an emulsion, by dispersing 15 parts of the polymer in 75.85 parts of water in the presence of 3 and 6 parts of emulsifiers obtained from the ethoxylation of secondary alcohols having from 12 to 14 carbon atoms respectively having 5 and 7 oxyethylene units.

EXAMPLE 2

A siloxane of the average formula $$(CH_3)_3SiO[(CH_3)_2SiO]_{392}[CH_3\underset{\underset{R}{|}}{SiO}]_8Si(CH_3)_3$$

wherein R denotes a group of the formula

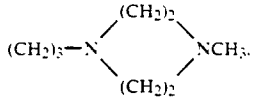

was prepared as follows.

A flask was equipped with a stirrer, condenser, dropping funnel and nitrogen blanket. 220 g (2.2 mole) of N-methylpiperazine was charged to the flask. The mixture was heated to 115° C. and 182.4 g (1 mole) of chloropropyl dimethoxy silane were slowly added. An exothermic reaction was observed. After complete addition the solution was maintained at 115° C. for 1 hour. After cooling to 20° C. the mixture was filtered and distilled giving in a yield of 70% of the theoretical value a silane of the formula

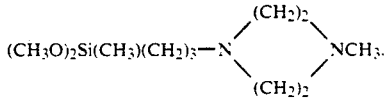

The silane was then analysed by proton NMR and further hydrolysed by adding excess water to it at reduced pressure (2.6 mbar) and heating to a temperature of 110° C. till all the excess water was stripped off. This gave a polymeric siloxane hydrolysate, which is believed to be a mixture of cyclic and linear siloxanes. 41.2 g of the hydrolysate was then equilibrated with 745 g of octamethylcyclotetrasiloxane and 6 g of hexamethyldisiloxane endblocker in the presence of 3 g of K-silanolate based catalyst. The equilibration reaction took place under a nitrogen blanket at 140° C for 5 hours, after which the excess catalyst was neutralised with acetic acid. This reaction yielded the above mentioned siloxane polymer.

The polymer was formulated into an emulsion in the way described for Example 1.

EXAMPLE 3

A siloxane of the average formula $$(CH_3)_3SiO[(CH_3)_2SiO]_{392}[CH_3\underset{\underset{R}{|}}{SiO}]_8Si(CH_3)_3$$

wherein R denotes a group of the formula

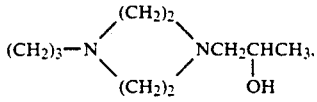

was by reacting 270 g of the siloxane polymer provided by Example 1 with 11 g of epoxybutane at 60° C. for 12 hours in the presence of 42 g of isopropanol, 16 g of methanol and 5 g of water. The resulting polymer was stripped under reduced pressure to give the above mentioned siloxane polymer.

The polymer was formulated into an emulsion in the way described for Example 1.

EXAMPLE 4

73 parts of the silane

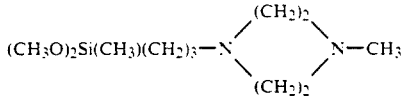

as prepared in Example 2, 1010 parts of a linear dimethylsilanol endblocked polydimethylsiloxane and 2 parts of $Ba(OH)_2$ were added to a flask, equipped with a temperature probe, a stirrer and a condenser under a nitrogen blanket. The flask was heated to 110° C. until no more volatiles were generated and allowed to cool under a nitrogen blanket. 2 parts of $Na_3PO_4$ were added, after which the flask was reheated to 110° C. under reduced pressure until the viscosity of the reaction product was stable. A cloudy white liquid was obtained and analysed giving a polymer of the average formula

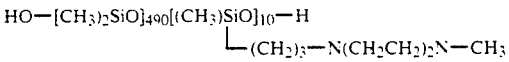

with a viscosity of 1520 $mm^2/s$. The polymer was incorporated into an emulsion according to the method disclosed in Example 1.

EXAMPLE 5

103 parts of the methyldimethoxy propylenemethylpiperazine silane as prepared in Example 2 was charged to a flask, together with 1500 parts of a short chain dimethylsilanol endblocked polydimethylsiloxane and 0.8 part of $Ba(OH)_2$. The mixture was heated under atmospheric pressure to 110° C. As soon as methanol started to reflux the pressure was reduced to 100 mbar and these conditions were maintained until the reaction product had a viscosity of 1000 $mm^2/s$. The resulting polymer was filtered through a bed of Dicalite® to give a crystal clear fluid with a viscosity of 1884 $mm^2/s$ being a mixture of materials with the average structure of

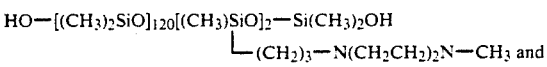

and

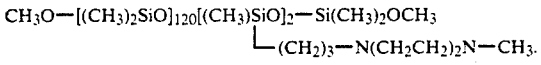

However, a number of polymers included small amounts of $CH_3SiO_{3/2}$ units, introducing a small percentage of branching into the polymers.

15 g of the polymer was emulsified by using 3 g of a secondary alcohol ethoxylate, 1 g of a polyoxyethylene nonylphenylether (20 EO units), 0.5 g of a hexadecyl trimethylammonium chloride solution, 0.3g of acetic acid, 1.5 g of propylene glycol and 78.7 g of water.

EXAMPLE 6

258 parts of the methyldimethoxy propylenemethylpiperazine silane as prepared in Example 2 was charged to a flask, together with 3757 parts of a dimethylsilanol endblocked polydimethylsiloxane having a viscosity of 50 $mm^2/s$ and 4 parts of $Ba(OH)_2—8H_2O$. The flask was heated under agitation until a steady reflux of methanol was observed. After reacting for 6 hours the pressure was reduced to strip off all volatiles until the viscosity had reached 2000 $mm^2/s$. The mixture was then cooled and filtered to give a colourless liquid with a viscosity of 2488 $mm^2/s$ and an average formula of

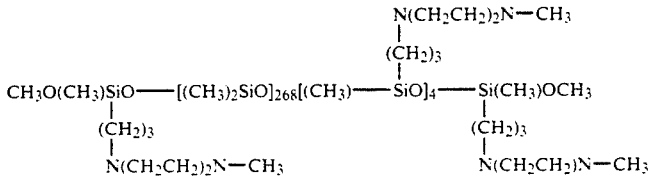

The polymer was incorporated into an emulsion according to the method disclosed in Example 5.

EXAMPLE 7

The emulsions of Examples 1 to 3 were padded onto various pieces of fabric in order to give a silicone uptake on the fabric of 0.5% by weight. The fabric samples were then cured in the case of optically brightened cotton fabric (OBC) for 5 minutes at 150° C., followed by 1 minute at 180° C. and in the case of scoured cotton towelling (SCT) and cotton weave (CW) for one minute at 150° C., followed by 1 minute at 180° C. The treated fabric pieces were then tested for whiteness and for softening. Softening was tested by a handling test by an expert panel rating 5 as very soft and 0 as not soft, while the whiteness index was measured using a Hunterlab Optical sensor, Model D25M. In order to assess the results properly, comparison with fabric pieces treated with different emulsions and with blank pieces were also carried out. Test results are given in the Table below.

Comparative Examples C1–C4

Example C1 was a siloxane of the average formula

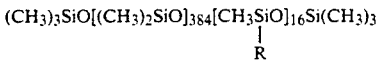

wherein R denotes a group of the formula $(CH_2)_3—NH—C_6H_{11}$, prepared according to the teaching of E.P. specification 0 360 935.

Example C2 was a siloxane of the average formula

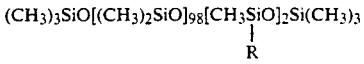

wherein R denotes an amide containing group of the formula $—CH_2CH(CH_3)CH_2NH(CH_2)_2NHC(O)(CH_2)_3OH$.

Example C3 was a siloxane of the average formula $$(CH_3)_3SiO[(CH_3)_2SiO]_{391.8}[\underset{\underset{R}{|}}{CH_3SiO}]_{9.2}Si(CH_3)_3$$

wherein R denotes an ethylene diamine containing group of the formula $-CH_2CH(CH_3)CH_2NH(CH_2)_2NH_2$.

The polymers $C_1$ to $C_3$ were formulated into an emulsion in the way described for Example 1.

Comparative Example C4 was a piece of untreated fabric (blank).

The emulsions of Comparative Examples C1 to C3 were padded onto various pieces of fabric as in Example 4. The fabric samples were then cured and tested as in Example 4 above.

The whiteness and softness were compared on several types of fabric. The following results were obtained:

| | Whiteness Index | | Softness | |
|---|---|---|---|---|
| Example | OBC | SCT | SCT | CW |
| 1 | 94.9 | 97.3 | 4.5 | 5.0 |
| 2 | 95.8 | 98.9 | 4.0 | 3.2 |
| 3 | 93.1 | 98.3 | 4.0 | 4.0 |
| C1 | 94.3 | 99.1 | 3.0 | 3.2 |
| C2 | 92.0 | 94.8 | 1.0 | 1.0 |
| C3 | 84.6 | 89.4 | 3.5 | 3.2 |
| C4 | 93.2 | 98.5 | 0.0 | 0.0 |

It can be seen from the results that the treating agents according to the invention give an improved softening effect over the prior art, and that the whiteness factor is such that hardly any yellowing can be observed.

EXAMPLE 8

The emulsions of Example 4 to 6 were padded onto pieces of textiles, as in Example 7, and tested for whiteness. No yellowing was observed on any one of the treated pieces.

That which is claimed is:

1. A method for treating fibrous materials which comprises applying to the fibrous materials a composition consisting essentially of a polydiorganosiloxane having at least one unit (a) of the general formula

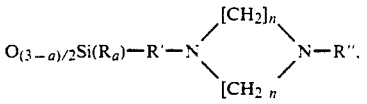

wherein R si as defined below and at least one unit (b) of the general formula $O_{(4-b)/2}$ Si-$R_b$ wherein R is selected from the group consisting of a hydroxyl group, monovalent hydrocarbon groups having up to 18 carbon atoms and hydrocarbonoxy groups having up to 18 carbon atoms, R′ is selected from the group consisting of divalent hydrocarbon groups, divalent hydrocarbon groups which contain oxygen, divalent hydrocarbon groups which contain nitrogen and divalent hydrocarbon groups which contain oxygen and nitrogen, and when oxygen is present in R′ it will be selected from ether oxygen, carboxylic oxygen, amido oxygen and hydroxyl oxygen. R″ is selected from the group consisting of hydrogen, alkyl groups, alkyl groups containing an oxygen atom in the form of a hydroxyl group, alkyl groups containing an oxygen atom in the form of a C=O group, and alkyl groups containing an oxygen atom in the form of a hydroxyl group and in the form of a C=O group, a has a value of 1 or 2, b has a value of 2 or 3, and each n independently has a value of from 2 to 8.

2. A method according to claim 1 wherein the polydiorganosiloxane is a substantially linear polymer.

3. A method according to claim 1 wherein the polydiorganosiloxane consists of from 10 to $10^5$ units of type (a) and type (b) combined.

4. A method according to claim 1 wherein the polydiorganosiloxane consists of from 100 to 1000 units of type (a) and type (b) combined.

5. A method according to claim 1 wherein 1 to 10 mole % of the of the siloxane units in the polydiorganosiloxane are units of type (a).

6. A method according to claim 1 wherein 1 to 4 mole % of the siloxane units in the polydiorganosiloxane are units of type (a).

7. A method according to claim 1 wherein the polydiorganosiloxane is applied to the fibrous material in the form of an emulsion comprising from 10 to 15% by weight of the polydiorganosiloxane.

8. A method according to claim 1 wherein the application to the fibrous material is followed by drying and heating the treated fibrous material.

9. A method according to claim 1 wherein R is only selected from the group consisting of hydroxyl and hydrocarbonoxy groups having up to 18 carbon atoms in those siloxane units (a) or (b) which are terminal units in the polymer.

10. A method according to claim 1 wherein at least 80% of all R substituents in the polydiorganosiloxane are lower alkyl groups.

11. A method according to claim 1 wherein R′ is selected from the group consisting of alkylene groups having 2 carbon atoms and alkylene groups having 3 carbon atoms.

12. A method according to claim 1 wherein no R′ group contains a primary amine group.

13. A method according to claim 1 wherein R″ is selected from the group consisting of hydrogen and lower alkyl groups and n has a value of 2.

14. A method according to claim 1 wherein sufficient polydiorganosiloxane is applied to the fibrous substrate to obtain a treatment of from 0.2 to 1% by weight of polydiorganosiloxane based on the weight of the fibrous material.

15. Fibrous materials which have been treated by a method according to claim 1.

16. A textile fabric incorporating fibrous materials which have been treated by a method according to claim 1.

* * * * *